US005199276A

United States Patent [19]

Sullivan

[11] Patent Number: 5,199,276

[45] Date of Patent: Apr. 6, 1993

[54] FAN COIL UNIT WITH NOVEL REMOVABLE CONDENSATE PAN

[76] Inventor: John T. Sullivan, 3910 Madison Ave., Hyattsville, Md. 20781

[21] Appl. No.: 790,876

[22] Filed: Nov. 12, 1991

[51] Int. Cl.[5] ..... F25D 21/14

[52] U.S. Cl. ..... 62/291; 220/571

[58] Field of Search ..... 62/285, 291; 220/571; 108/108, 109; 312/263, 265.6

[56] References Cited

U.S. PATENT DOCUMENTS

| | | | |
|---|---|---|---|
| 969,822 | 9/1910 | Wheeler | 108/109 |
| 2,899,803 | 8/1959 | Paley | 62/291 |
| 3,050,958 | 8/1962 | Allender | 62/285 |
| 3,491,550 | 1/1970 | Cavis | 62/285 |
| 3,524,328 | 8/1970 | Schuster | 62/285 |
| 3,620,039 | 11/1971 | Williams | 62/285 |
| 4,000,779 | 1/1977 | Irwin | 62/285 X |
| 4,416,327 | 11/1983 | Nakado et al. | 62/285 X |

*Primary Examiner*—William E. Tapoicai

*Attorney, Agent, or Firm*—Diller, Ramik & Wight

[57] ABSTRACT

A fan coil unit as provided which includes a housing defining a chamber within which is located a condensation pan and a fan board with the fan board being reinforced by a reinforcing rib which also functions to removably secure the condensation pan to the fan board. The fan board is also supported in the absence of conventional fasteners relative to a rearmost or uppermost wall of a housing of the fan coil unit to facilitate assembly/disassembly of the components thereof. A groove is also formed along one surface of the condensation pan to serve as a location device for aligning fasteners with associated panel mounts of the housing. The condensation pan is also preferably of a hollow extruded construction and includes a variety of different configured ribs to lengthen the thermal path across internal chambers to thereby decrease/reduce thermal conductivity and associated condensation.

27 Claims, 4 Drawing Sheets

FAN COIL UNIT WITH NOVEL REMOVABLE CONDENSATE PAN

BACKGROUND OF THE INVENTION

Residential and commercial air conditioners include as a part thereof a fan coil unit. The fan coil unit includes a coil through which coolant (liquid or gas) is pumped, and normally the coil is spaced above or seated in a condensation tray, condensation pan or convector tray in which condensation collects as air passes through the coil and condenses upon the exterior thereof in the air conditioning mode of operation. The condensate drips from the coil into the condensation pan and is conducted by an appropriate outlet(s) and pipe to a conventional drain.

Such condensation pans are generally made from galvanized metal and rust quite readily. Disadvantages of the latter and the manner in which the same are overcome through the construction of an in situ vacuum molded polymeric/copolymeric synthetic plastic material condensation pan are set forth in U.S. Pat. No. 4,856,672 issued on Aug. 15, 1989 in the name of John T. Sullivan. However, though the condensation pan of the latter patent possesses many advantages, one disadvantage is the necessity of using numerous separate and removable fasteners/connectors, such as nuts, bolts and screws, to assemble and disassemble the condensation pan relative to the associated fan coil unit, its housing or a fan board thereof.

Additional novel and unobvious condensation pans are disclosed in U.S. Pat. No. 4,986,087 issued on Jan. 22, 1991 in the name of John T. Sullivan. The condensation pans of the latter patent are more readily installed within and removed from the fan coil unit through the sliding connections between the two. However, the sliding connections necessitate expensive molds for fabrication purposes which in turn necessitate increased cost of each condensation pan. Accordingly, the industry not only requires a condensation pan/tray which includes all of the advantages heretofore noted in the latter-identified patents, but such condensation pan must be cost-effective and price competitive.

Most recently a patent application has been filed on Sep. 16, 1991 under Ser. No. 07/760,538 in the name of John T. Sullivan entitled Fan Coil Unit with Novel Removable Condensation Pan, which includes a condensation pan having an elongated pan body having opposite sides terminating in a hook. The pan body is made from extruded material, such as polymeric/-copolymeric resin, metal or the like, or it can be made from sheet metal. The hooks snap-secure the condensation pan to an associated fan board and a condensation tray/pan mounting board in the absence of conventional separate fasteners, such as nuts and/or bolts and-/or screws. Thus, the latter construction allows the condensation pan to be readily assembled and disassembled in the absence of utilizing such tools as screwdrivers, pliers, wrenches or the like, by merely removing a front wall of the fan coil unit and quickly unsnapping/-snapping the condensation pan relative to the pan board and the condensation pan mounting board. In this manner the condensation pan can be readily removed from the fan coil unit for such purposes as inspection, repair and/or replacement. Obviously, such snap-securement in the absence of any type of added fastening means can be achieved in a relatively straightforward and rapid manner.

Reference is also made to the condensation pan disclosed in pending application Ser. No. 07/734,716 filed Jul. 23, 1991 in the name of John T. Sullivan, and now U.S. Pat. No. 5,174,467, which is a continuation-in-part of U.S. Pat. No. 5,071,027, and which discloses a condensation pan formed as a hollow body defining one or more chambers. The chamber or chambers of the hollow condensation pan are either hollow or can be filled with insulation, and in either case thermal conductivity across the opposite surfaces of the condensation body is reduced to limit/lessen the formation of "sweat"/condensate.

SUMMARY OF THE INVENTION

In keeping with the present invention, a condensation pan is provided for fan coil units of air conditioners/-heat exchangers, and includes a condensation body having a reinforcing rib depending therefrom. The reinforcing rib is fastened by removable securing means to an edge of an associated fan board which permits the latter to be readily assembled and disassembled relative to each other. Preferably an edge of the fan board is simply supported upon a ledge of a rear wall of the fan coil unit, and once a front wall or panel of the housing is removed, the entire condensation pan and fan board can be removed as a unit or individually.

In further accordance with the present invention, the condensation body of the condensation pan is preferably formed as a hollow extruded member, and means are provided along one of its edges to delineate an area for fasteners to penetrate the same for securing the condensation pan to a flange of the fan coil unit housing. The latter assures correct alignment between the latter fasteners and the fan coil unit housing flange.

In further accordance with the present invention, the condensation pan and the fan board are secured to each other at a predetermined angle, and the latter angle is retained and maintained by (a) the support effected between a ledge of a housing wall and an edge of the fan board and (b) a removable connection between a flange of a wall of the housing and an associated edge of the condensation pan.

In further accordance with this invention, separate end walls or end caps associated with the condensation body to form the condensation pan are preferably provided with one or more condensate outlets, and in one particular embodiment of the present invention two condensate outlets associated with at least one of the end walls or caps allows the condensation pan to be associated with a fan coil unit operative selectively vertically or horizontally.

In further accordance with the present invention, the condensate body is preferably of an extruded synthetic polymeric/ copolymeric construction with at least one rib spanning a predetermined distance between inner surfaces of a chamber of the extruded condensate body, and the rib is either angled, stepped or sinusoidal to lengthen the thermal path which in turn decreases the thermal conductivity across the condensation body to thereby reduce "sweat" or the formation of condensation.

With the above and other objects in view that will hereinafter appear, the nature of the invention will be more clearly understood by reference to the following detailed description, the appended claims and the several views illustrated in the accompanying drawings.

DESCRIPTION OF THE PREFERRED EMBODIMENTS

Figure 1:
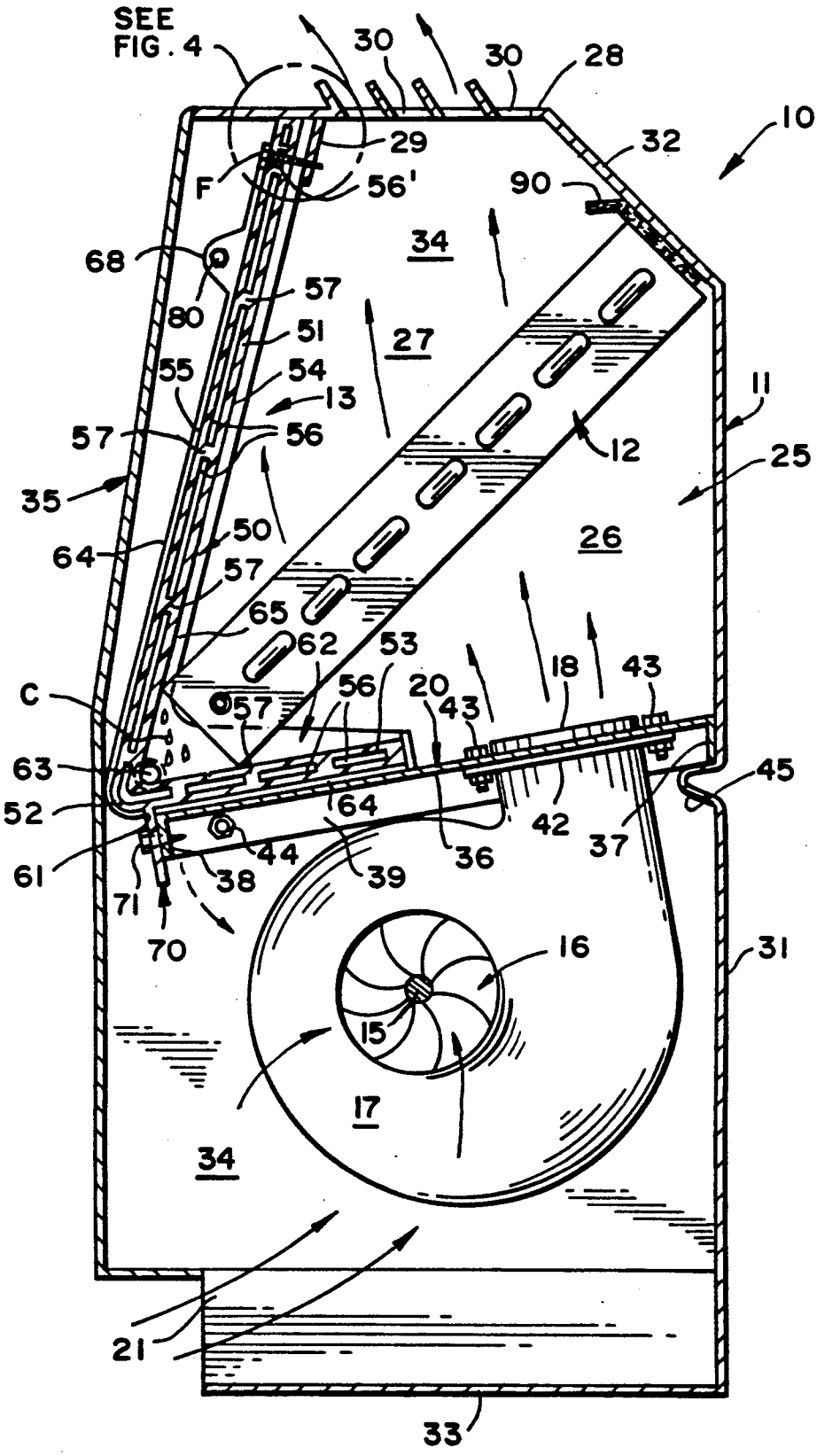
FIG. 1 is a vertical cross-sectional view through a novel fan coil unit of the present invention, and illustrates a condensation pan defined by a hollow extruded condensation body which includes a reinforcing rib, means removable securing the condensation body to a flange of a housing of a fan coil unit and an edge of a fan board, and a ledge of the housing supporting another edge of the fan board.

A novel fan coil unit is illustrated in FIG. 1 of the drawings and is generally designated by the reference numeral 10.

The fan coil unit 10 includes a housing 11, a condensation/evaporation coil 12, a primary condensation pan/tray or convector tray 13, a motor (not shown) which rotates a shaft 15 of a fan 16 mounted in a fan housing 17 which includes an outlet 18 for directing air through an opening (unnumbered) of a fan board 20, as is indicated by the unnumbered headed arrows in FIG. 1. The air is thereby drawn through a bottom inlet 21 into the fan housing 17 and exits the latter through the outlet 18 passing into a lower chamber portion 26 of a chamber 25 which houses the coil 12. The air passes through the coil 12, enters an upper chamber portion 27 of the chamber 25 and exits a top wall or panel 28 through slits or openings 30. When in the air conditioning mode of operation of the fan coil unit 10, condensate C forms and collects upon the coil 12, drips therefrom into the condensation pan 13 and is discharged in a conventional manner, as set forth in the latter-identified patent applications/patents.

The housing 11 corresponds generally to the housings described in the latter-identified patents, the details of which are herein incorporated by reference. However, the housing 11 includes, in addition to the top wall or panel 28, a rear wall or panel 31 joined by a juncture wall or panel 32 to the top wall or panel 28. The rear wall or panel 31 is also joined to a bottom wall or panel 33 and to two opposite generally parallel side walls or panels of which only a side wall or panel 34 is illustrated. However, the side walls 34 are not only parallel to each other but are generally normal to the panels 28, 31, 32, 33 and a removable front wall or panel 35. The movable front wall 35 is secured by fasteners (not shown) or conventional means to the panels 28, 33 and/or 34 to facilitate ready access into the chamber 25 for purposes of inspecting, removing, repairing and/or replacing any one or all of the various components internally thereof, as, for example, the coil 12, the condensation pan 13, the fan board 20, etc. The latter is achieved by the novel construction and unification of the fan board 20 and the condensation pan 13, as well as the assembly thereof relative to the rear wall or panel 31 and the top wall or panel 28, as will be described more fully hereinafter.

The fan board 20 is preferably constructed from metallic material, such as sheet metal, and includes a main body 36 which extends between the side walls 34 and which is of a generally polygonal/rectangular configuration, as viewed from above or below. The main body 36 includes a depending rear flange 37, a depending front flange 38 and opposite generally parallel side flanges of which only a single depending side flange 39 is shown. The main body 36 of the fan board 20 includes one or more openings into and through which project the outlet 18 of the fan housing 17. The outlet 18 of the fan housing 17 is snap-secured to the main body 36, as is disclosed in the latter identified patents, or can be conventionally secured thereto through a flange 42 of the fan housing 17 which is removable secured to the main body 36 of the fan board 20 by conventional fasteners, such as nuts and bolts 43. Similar conventional nuts and/or bolts and fasteners 44 secure each side flange 39 to one of the side walls 34 of the housing 11.

Means generally designated by the reference numeral 45 are formed from the rear wall 31 in the form of a single elongated shelf or ledge which extends the length of the rear wall 31 between the side walls 34. In lieu of the single ledge 45, the ledge 45 can be formed as a series of two or more spaced ledges upon which the rear flange 37 rests in the absence of any conventional fastening means securing the rear flange 37 to either the ledge 45 or the rear wall 31.

Figure 2:
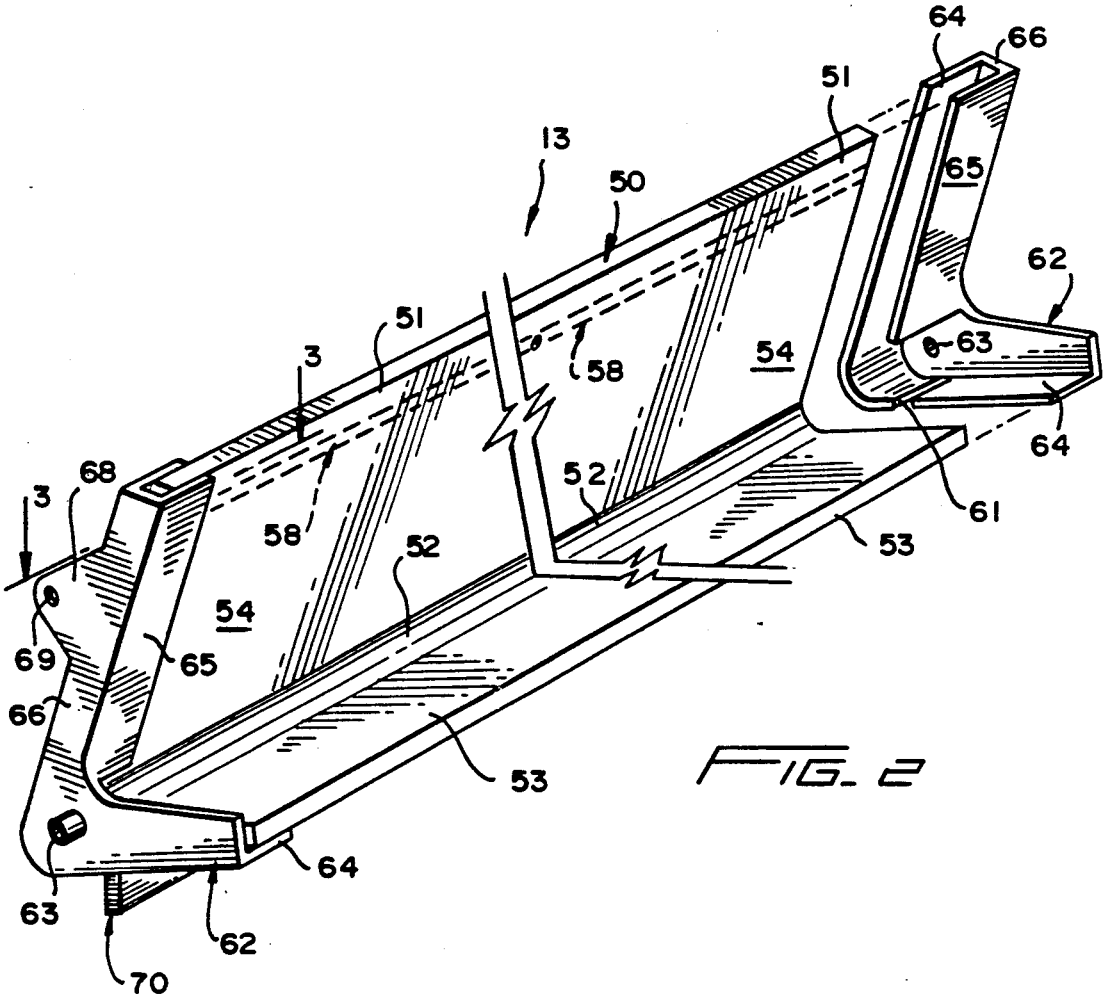
FIG. 2 is a fragmentary exploded perspective view of the condensation pan or tray of FIG. 1, and illustrates separate end caps associated therewith.

The condensation pan 13 includes a main pan body 50 (FIG. 2) formed from extruded synthetic polymeric/copolymeric resinous material, aluminum or the like. The main pan body 50 is of a generally hollow construction, and includes a hollow wall 51 joined by a hollow juncture wall 52 to another hollow wall 53. The walls 51 through 53 are defined by a common inner surface 54 and a common outer surface 55 with the walls 51, 53 being disposed to each other at a predetermined angle which is less than 90 degrees, as is most evident from FIGS. 1 and 2 of the drawings. A series of condensation collection means or chambers run the length of the main pan body 50 and are separated from each other by a plurality of ribs 57. The chambers 56 function in the manner heretofore described in the latter-noted patents, and essentially accumulate or collect condensation therein which subsequently flows outwardly of the chambers 56 through either or both of the longitudinally opposite ends (unnumbered) thereof for subsequent discharge through outlets 63 (FIG. 2) of identical end caps or walls 62 sonically or otherwise bonded to the walls 51 through 53.

As is clearly apparent from U.S. Pat. No. 5,071,027, when the condensation/evaporation coil 12 is operating in the air conditioning mode, relatively cold refrigerant cools the coil which in turn cools the convector tray 13 through conduction because the coil 12 rests directly upon inner surfaces of the convector tray 13. Warmer ambient air surrounds the tray 13, particularly at the bottom, including ambient air within the condensation channels/chambers 56 which is formed into condensation droplets eventually collecting within the channels 56 in sufficient amounts to form condensation which then flows outwardly of the channels 56 for subsequent discharge through the outlets 63.

Figure 3:
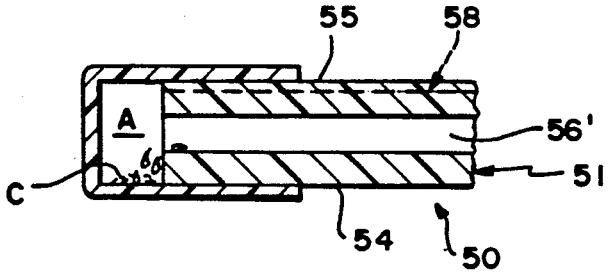
FIG. 3 is an enlarged fragmentary cross-sectional view taken generally along line 3—3 of FIG. 2, and illustrates the manner in which one of the end caps or walls is secured to the condensation body.
Figure 4:
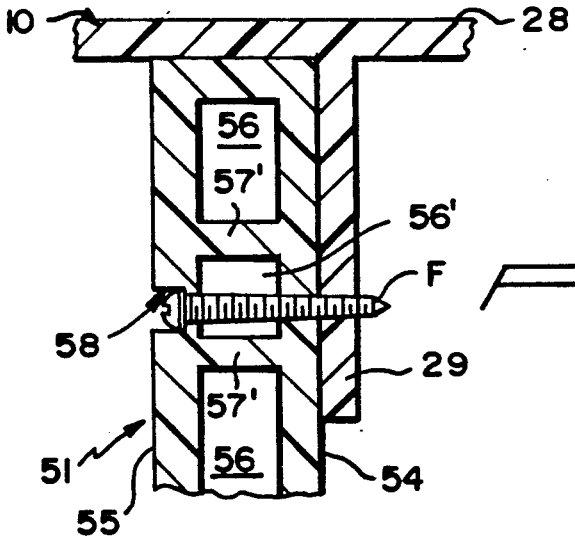
FIG. 4 is an enlarged fragmentary view of the encircled portion of FIG. 1, and illustrates a fastener passing between ribs of the hollow condensate body and securing the latter to a flange depending from a top wall of the fan unit housing.

The wall 51 along the outer surface 55 includes means 58 (FIGS. 2 and 4) extending the length of the wall 51 (FIG. 2) generally parallel to the longitudinal axis thereof and in parallel alignment with a selected one of the chambers 56 which is identified in FIGS. 1, 3 and 4 of the drawings by the reference numeral 56' to distinguish the chamber 56' from the adjoining chambers 56, 56. Ribs which are parallel to each other to either side of and which define the chamber 56' are also identified in FIG. 4 by the reference numerals 57' to distinguish the ribs 57' on the other ribs 57'. The means or groove 58 is formed in the wall 51 opening outwardly through the outer surface 55 to serve as a locator for conventional fasteners, such as a self-threading, self-tapping screw F (FIGS. 1 and 4). Since the groove 58 is aligned with and is parallel to the chamber 56' between the ribs 57', the screw F, when threaded from left-to-right in FIG. 4 will always pass through the chamber 56' and will not contact any of the ribs 57 or 57'. Thus, the location of the groove 58 assures that during the assembly of the condensation pan 13 within the upper chamber portion 27 (FIG. 1), each of the fasteners/screws F will pass through the chamber 56' and into a depending flange 29 of the top wall 28 (FIGS. 1 and 4). In the absence of the groove 58, one might accidentally thread the fasteners F through either of the ribs 57' which would be a laborious process because of the thickness thereof and which would, of course, also weaken the hollow wall 51 in the area of a rib so damaged. However, the groove 58 precludes such "blind" application of the fasteners F and assures that each fastener F when threaded through the wall 51 in the area of the groove 58 will pass through the chamber 56' and eventually self-thread into the flange 29 of the top wall or panel 28 to thereby secure an upper end (unnumbered) of the condensation pan 13 to the top wall or panel 28.

The condensation pan 13 also includes reinforcing means generally designated by the reference numeral 70 which extends the length of the main pan body 50 between the ends thereof generally in the area of the juncture wall 52. The reinforcing means 70 is an integral rib formed during the extrusion of the main pan body 50 and longitudinally reinforces the condensation pan 13 along the length thereof. The reinforcing means or rib 70 also functions in conjunction with the flange 38 as means for securing the latter to each other in conjunction with one or more conventional fastening means in the form of screws or bolts 71 (FIG. I) which are simply threaded into and through the reinforcing ribs 70 and into the depending front flange 38 of the fan board 20.

Each of the end walls or caps 62 includes an outer leg 64, and inner leg 65 and a bight portion or leg 66 therebetween which includes an outwardly directed flange 68 having an opening 69 which receives conventional fastening means 80 (FIG. 1) in the form of nuts/bolts for securing the flange 68 of each end wall or cap 62 to the associated side wall 34 of the housing 11. Each inner leg 65 is also relatively short, as compared to each outer leg 64, as is indicated best by the uppermost end cap 62 of FIG. 2. In addition, the outer leg 64 of each end cap 62 includes a slot 61 which snugly meets with an associated end portion (unnumbered) of the reinforcing rib 70. The legs 64, 65 are solvent, sonically or otherwise, hermetically bonded to the outer and inner surfaces 55, 54, respectively, of the walls 51 through 53, as are the end portions (unnumbered) of the ribs 70 to the slots 61. Thus, condensation C (FIG. 3) which accumulates in the chambers 56, 56' flows endwise therefrom into an area or space A (FIG. 3) between each of the bight portions 66 and the ends (unnumbered) of the main pan body 50 and flows therefrom through the outlets 63 to an appropriate drain.

The condensation/evaporation coil 12 rests between the condensation pan 13 and the juncture wall 32 of the housing 11. An elongated strip of insulation 90 is sandwiched between the junction wall 32 and an upper end portion (unnumbered) of the coil 12 to reduce the formation of the condensate thereat.

Due to the construction of the fan coil unit 10 heretofore described, the assembly and disassembly of the components relative to the housing 11 are relatively straightforward, simple, fast and effortless. For example, if the entire fan board 20 and condensation pan 13 is to be removed as a unit, the front panel 35 is removed and the fasteners F, 44 and 80 are removed resulting in the entire unitized removal of the condensation pan 13 and the fan board 20 with, of course, the fan housing(s) 17 carried by the latter. Depending upon the size of the overall fan coil unit 10, it might not be necessary to utilize the fasteners 80, and in such circumstances the fan board 20 and the condensation pan 13 can be removed as a unit simply by removing the fasteners F and 44.

If only the fan board 20 is to be removed, only the fastener(s) 71 need be removed along with the fasteners 44, although the latter are not necessarily required when the fan coil unit 10 is of a relatively shallow length, as measured between the side walls 34. In the latter case, the fastener(s) 71 is removed and the fan board 20 can simply be pivoted down and to the left, as indicated by the unnumbered dashed headed arrow associated therewith in FIG. 1 which will release the flange 37 from atop the ledge 45 to permit the entire fan board 20, and the fan housing(s) 17 and the associated fan motors carried thereby to be removed outwardly and to the left, again as viewed in FIG. 1, through the opening formed by the removal of the front wall 35.

If the condensation pan 13 alone is to be removed, one need but remove the fasteners F, 71 and 80, although the latter may not be required as heretofore noted for fan coil units 10 of shallow depth, again as measured between the side walls 34.

It is important to note from the foregoing that none of the fasteners F, 80, 71 and 44 are at the front of the housing 11 and are, in fact, all relatively accessible in the area of the removable front wall 35. Also, there are no fasteners anywhere at the rear wall 31, particularly associated with the rear flange 37 of the fan board 20. Thus, assembly and disassembly of the fan board 20 per se, the condensation pan 13 per se, or the latter as a unitized structure is relatively straightforward and is quite simple because of the accessibility of the various fasteners from the front end or front side of the housing 11, namely, from the left-hand side of the fan coil unit 10, as viewed in FIG. 1 upon the removal of the front wall or panel 35 thereof.

Figure 5:
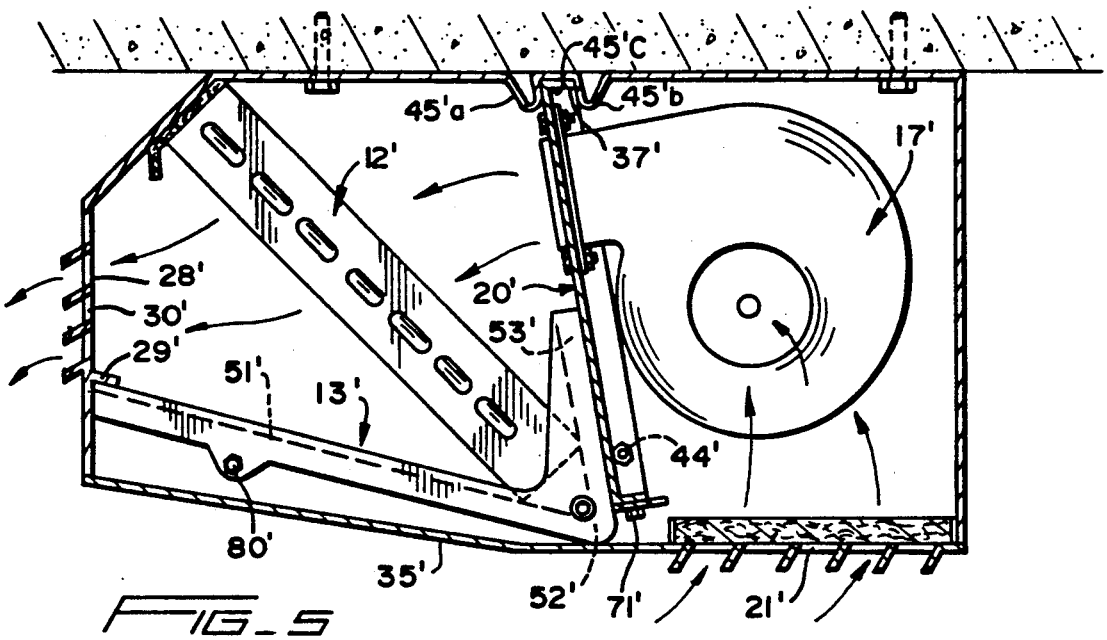
FIG. 5 is a vertical cross-sectional view of another fan coil unit of the present invention, and illustrates the same suspended from a ceiling.

The fan coil unit 10 of FIG. 1 is illustrated in its operative upright or vertical position, but the same with but a slight modification can be utilized as a ceiling or wall unit, as is shown in FIG. 5. In FIG. 5, the identical fan coil unit, except for one major variation, is designated by the reference 10' and includes a housing 11' having a rear wall or panel 31' which in this case is provided with two generally parallel ledges or ribs 45'a and 45'b defining therebetween a channel or groove 45'c opening toward a removable bottom wall or panel 35', which in this case includes a louvered bottom inlet or opening 21'. A rear flange 37' of the fan board 20' is received in the channel 45'c and is held therein by the ledges or ribs 45'a, 45'b which prevents the fan board 20' from moving to the left or right, as viewed in FIG. 5, while bottom or downward movement is precluded by the connection of the fan board 20' to the condensation pan 13' which is in turn secured to a flange 29' of the top wall or panel 28' by appropriate fasteners (not shown) corresponding to the fasteners F. In this case, fasteners 44' should be utilized, although the fasteners 80' are not necessarily required. Fasteners 71' are utilized, and are generally utilized in all circumstances since they establish the angular relationship between the fan board 20' and the condensation pan 13', as well as the walls 51', 53' thereof.

Figure 6:
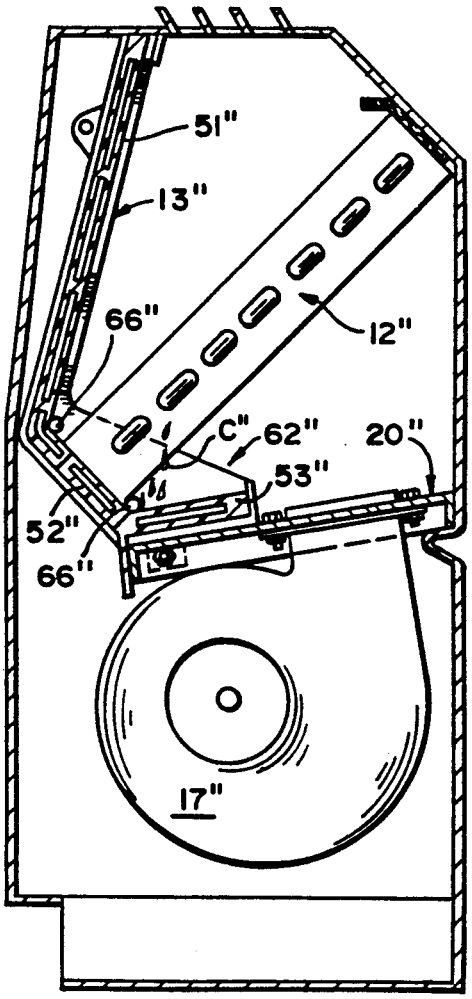
FIG. 6 is a vertical cross-sectional view of another fan coil unit of the present invention, and illustrates a condensation pan defined by three angularly related walls of a hollow extruded condensation body with adjacent walls defining junctures at which are located condensation openings of an associated end wall or cap.

Reference is now made to FIG. 6 of the drawings which illustrates another fan coil unit 10'' in which components corresponding to those heretofore described are identified by the identical though double primed reference numerals. In this case, a condensation pan 13'' is defined by hollow walls 51'', 53'' spanned by a relatively elongated hollow juncture wall 52''. Due to the elongated nature of the wall 52'', two juncture portions (unnumbered) are defined between the walls 51'', 52'' and the walls 52'', 53'' and at each of which there is an outlet opening 66'' in each of the end caps or walls 62''. Due to the latter construction, when the fan coil unit 10'' is utilized in its vertical position, as shown in FIG. 6, condensation C'' will drain through the lowermost of the two illustrated outlets 66'', whereas if the fan coil unit 10 is utilized as a ceiling mounted unit, which in effect means that the fan coil unit 10'' is rotated 90 degrees counterclockwise from that shown in FIG. 6, the remaining and now lower of the outlets 66'' will drain the Condensate C'' from the pan 13''. The fan coil unit 10'' is otherwise identical to the fan coil unit 10 heretofore described.

Figure 7:
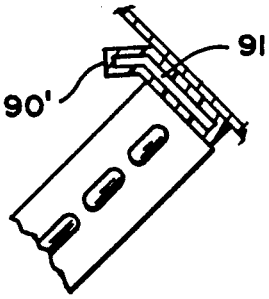
FIG. 7 is a fragmentary enlarged end view, partially in cross section, of a coil and a hollow insulation member between an edge of the coil and a wall of a fan coil housing.

FIG. 7 represents the utilization of insulation means 90' in the form of an elongated hollow strip of synthetic extruded polymeric/copolymeric resinous material, which is used in lieu of the fibrous (fiberglass) insulation 90 of FIG. 1. In this case, the insulation unit or strip 90' has closed opposite longitudinal ends and the interior of an associated chamber 91 is empty or it can be filled with an insulating gas, or with an insulating material, such as foamed polystyrene. In each of the latter cases, the insulation means or strip 90' prevents/reduces the formation of condensation as might normally occur between the relatively cold temperature of the associated coil (unnumbered) and the exterior of the juncture wall (unnumbered) during the air conditioning cycle associated therewith.

Figure 8:
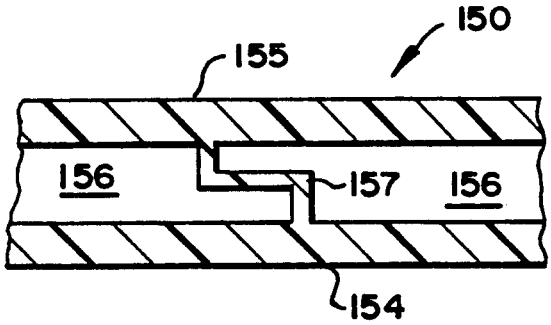
FIGS. 8 through 10 which appear on the sheet of drawing containing FIG. 4 are enlarged fragmentary cross-sectional views taken through three different extruded condensation bodies, and each illustrates a relatively long rib for increasing the thermal path across opposite surfaces of the condensate body to thereby decrease thermal conductivity and associated condensation/"sweat."
Figure 9:
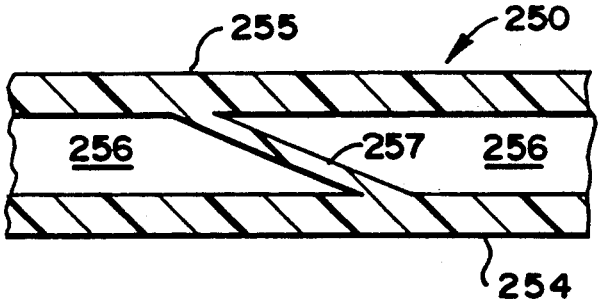
Figure 10:
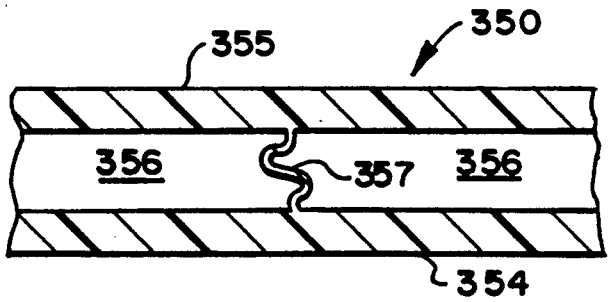

References is now made to FIGS. 8 through 10 of the drawings which illustrates the cross section of three different condensation main pan bodies 150, 250 and 350, respectively. The bodies 150, 250 and 350 include respective inner and outer surfaces 154, 155; 254, 255; and 354, 355; respective chambers 156, 256 and 356; and respective ribs 157; 257 and 357 between the respective chambers 156, 256 and 356. The distinguishing characteristic of the pan bodies 150, 250 and 350, as compared to the pan body 50, is the effective length of the ribs 157, 257 and 357, as compared to the ribs 57. The ribs 57 are normal to the surfaces 54, 55 and thus define a very short path of thermal conduction/conductivity between the inner and outer surfaces. Obviously, if the thermal path between the inner and outer surfaces can be lengthened, the thermal conductivity thereof will be decreased and the condensation or "sweat" would be correspondingly reduced. Thus the ribs 157, 257 and 357 establish lengthened thermal paths of conductivity which decrease thermal conductivity and, hence, reduce "sweat" and condensation.

In FIG. 8, the rib 157, as well as the remaining unillustrated ribs, is of a stepped or angulated configuration, and, obviously, the overall length thereof is appreciably longer, as viewed in the transverse direction, than is, for example, the length of a rib normal to the surfaces 154, 155. Hence, the stepped or angulated rib 157 effectively lengthens the thermal conductivity path of travel and, hence, reduces the formation of "sweat" or condensation. Obviously, the angulated rib 257 of FIG. 9 and the sinusoidal or "wave"-formed rib 357 of FIG. 10 effectively perform a like function of decreasing thermal conductivity by lengthen the thermal path between the respective surfaces 254, 255 and 354, 355.

Although a preferred embodiment of the invention has been specifically illustrated and described herein, it is to be understood that minor variations may be made in the apparatus without departing from the spirit and scope of the invention, as defined the appended claims.

What is claimed is:

1. A fan coil unit comprising a housing defining a chamber, a condensation pan and a fan board in said chamber, said condensation pan being defined by a body and opposite separate end walls, and said body being an extruded member, and means for reinforcing said condensation pan, said reinforcing means being an elongated rib extending longitudinally between said end walls.

2. The fan coil unit as defined in claim 1 wherein said reinforcing means is an extruded portion of said extruded member.

3. The fan coil unit as defined in claim 1 wherein said condensation pan includes a first wall in abutment with a first wall of said fan board, said fan board further includes a second wall disposed at an angle to said fan board first wall, and said reinforcing means being in abutting relationship with said fan board second wall.

4. The fan coil unit as defined in claim i wherein said condensation pan includes a first wall in abutment with a first wall of said fan board, said fan board further includes a second wall disposed at an angle to said fan board first wall, said reinforcing means being in abutting relationship with said fan board second wall, and said removable securing means removably securing said reinforcing means to said fan board second wall.

5. The fan coil unit as defined in claim I wherein said condensation pan includes a first wall in abutment with a first wall of said fan board, said fan board further includes a second wall disposed at an angle to said fan board first wall, said reinforcing means being in abutting relationship with said fan board second wall, said removable securing means removably secure said reinforcing means to said fan board second wall, and said removable securing means is a fastener removably secured to said reinforcing means and said fan board second wall.

6. The fan coil unit as defined in claim 1 wherein said condensation pan includes a first wall in abutment with a first wall of said fan board, said fan board further includes a second wall disposed at an angle to said fan board first wall, said reinforcing means being in abutting relationship with said fan board second wall, said removable securing means removably secure said reinforcing means to said fan, board second wall, and said removable securing means is a screw fastener removably secured to said reinforcing means and said fan board second wall.

7. The fan coil unit as defined in claim 1 wherein said reinforcing means is an extruded portion of said extruded member.

8. The fan coil unit as defined in claim 1 wherein said reinforcing means is in interengaged relationship with said end walls.

9. The fan coil unit as defined in claim 1 wherein said end walls each have a slot, and an end portion of said elongated rib is engaged in an associated one of said slots.

10. The fan coil unit as defined in claim 1 wherein said condensation pan includes a first wall in abutment with a first wall of said fan board, said fan board further includes a second wall disposed at an angle to said fan board first wall, and said reinforcing means being in abutting relationship with said fan board second wall.

11. A fan coil unit comprising a housing defining chamber, a condensation pan and a fan board in said chamber, means for reinforcing said condensation pan, said reinforcing means being in abutting relationship with said fan board to thereby accurately locate said condensation pan and fan board relative to each other.

12. A fan coil unit comprising a housing defining a chamber, a condensation pan and a fan board in said chamber, means for reinforcing said condensation pan, means for removably securing said condensation pan to said fan board by virtue of said reinforcing means, said condensation pan being defined by a body and opposite separate end walls, and said reinforcing means being an elongated rib in interengaged relationship with said end walls.

13. A fan coil unit comprising a housing defining a chamber, a condensation pan and a fan board in said chamber, means for reinforcing said condensation pan, means for removably securing said condensation pan to said fan board by virtue of said reinforcing means, said condensation pan being defined by a body and opposite separate end walls, said reinforcing means is an elongated rib, said end walls each have a slot, and an end portion of said elongated rib is engaged in an associated one of said slots.

14. A fan coil unit comprising a housing defining a chamber, said chamber being defined in part by first and second relatively spaced opposite walls, said second wall being relatively movable to gain access into said chamber, said chamber further being defined by third and fourth relatively spaced opposite walls disposed in generally transverse relationship to said first and second walls, a fan board in generally spanning relationship to said walls and setting-off therewith opposite chamber portions of said chamber, said first wall having means for supporting a first edge of said fan board, means for securing said fan board to at least one of said second, third and fourth walls, a condensation pan associated with a coil in one of said chamber portions, means for removably securing said condensation pan to said fan board, means for reinforcing said condensation pan, said removably securing means being constructed and arranged to removably secure said reinforcing means to said fan board, said reinforcing means being an elongated rib, said condensation pan being defined by a body and opposite separate end walls, and said body being an extruded member.

15. A fan coil as defined in claim 14 wherein said condensation pan and fan board can be bodily removed from said chamber upon removal of said fan board securing means.

16. The fan coil as defined in claim 14 wherein said first wall supporting means is a ledge formed from the material of said first wall.

17. The fan coil as defined in claim 14 wherein said first wall supporting means is a channel.

18. The fan coil as defined in claim 14 wherein said first wall supporting means is a channel defined by a pair of spaced ledges formed from the material of said first wall.

19. The fan coil unit as defined in claim 14 wherein said is an extruded portion of said extruded member.

20. A fan coil unit comprising a housing defining a chamber, said chamber being defined in part by first and second relatively spaced opposite walls, said second wall being relatively removable to gain access into said chamber, said chamber being further defined by third and fourth relatively spaced opposite walls disposed in generally transverse relationship to said first and second walls and a fifth wall disposed in generally transverse relationship to said first through fourth walls, a fan board in generally spanning relationship between said third and fourth walls, a condensation pan in generally spanning relationship between said third and fourth walls, first means for removably securing said condensation pan and fan board together to define a predetermined angle therebetween, means for supporting said fan board relative to said first wall, and second means for removably securing said condensation pan to said fifth wall whereby said first and second removably securing means and said supporting means collectively maintain said predetermined angle while permitting access to said chamber and said condensation pan and fan board through an access opening defined by movement of said second wall.

21. The fan coil unit as defined in claim 20 including further means for removably securing said condensation pan to said third and fourth walls.

22. The fan coil unit as defined in claim 20 including further means for removably securing said fan board to said third and fourth walls.

23. The fan coil unit as defined in claim 20 including further means for removably securing said condensation pan to said third and fourth walls, and additional means for removably securing said fan board to said third and fourth walls.

24. The fan coil unit as defined in claim 20 wherein said condensation pan includes a hollow body having at least one chamber defined between a pair of ribs, and said second removable securing means pass through said one chamber.

25. A fan coil unit comprising a housing defining a chamber; a condensation pan; fan board and coil in said chamber, said fan board setting-off upper and lower chamber portions, said coil being disposed in said upper chamber portion with a first coil edge adjacent said condensation pan and a second coil edge adjacent a wall of said housing, a fan and fan housing associated with said fan board for directing air from said lower chamber portion into said upper chamber portion and through said coil whereby condensation formed upon said coil will deposit in said condensation pan, and hollow means between said wall and second coil edge for reducing the thermal conductivity therebetween.

26. The fan coil unit as defined in claim 25 wherein said hollow thermal conductivity reducing means is an extruded member.

27. The fan coil unit as defined in claim 25 wherein said hollow thermal conductivity reducing means is an extruded synthetic polymeric/copolymeric plastic member.

* * * * *